United States Patent [19]

Prescott et al.

[11] 4,316,751

[45] Feb. 23, 1982

[54] ELECTRICAL RESISTANCE COATING FOR STEEL

[75] Inventors: Thomas J. Prescott, Troy; Raymond L. Wetzel, Southfield, both of Mich.

[73] Assignee: Hooker Chemicals & Plastics Corp., Warren, Mich.

[21] Appl. No.: 139,902

[22] Filed: Apr. 14, 1980

[51] Int. Cl.[3] ..... C23F 7/10

[52] U.S. Cl. ..... 148/6.15 Z; 148/6.15 R

[58] Field of Search ..... 148/6.15 R, 6.15 Z

[56] References Cited

U.S. PATENT DOCUMENTS 2,465,247 3/1949 McBride ..... 148/6.15 Z 3,114,661 12/1963 Palm ..... 148/6.15 Z

*Primary Examiner*—Ralph S. Kendall

*Attorney, Agent, or Firm*—Arthur E. Kluegel

[57] ABSTRACT

Disclosed is a process for applying an electrical insulating coating onto a ferrous metal surface and the ferrous metal surface with the coating thereon. The insulating coating comprises phosphate and nitrate applied in a thin film of from about 200 mg to about 400 mg coating weight per square foot of ferrous metal surface coated.

12 Claims, No Drawings

ELECTRICAL RESISTANCE COATING FOR STEEL

BACKGROUND OF THE INVENTION

The present invention relates to a process for coating a ferrous metal surface with an electrical insulating coating and to ferrous metal articles, especially electrical steel articles, having an electrical insulating coating thereon. More particularly, the present invention relates to a process for providing a thin electrical insulating coating on a ferrous metal surface, which coating comprises phosphate and nitrate anions and is cured at a low temperature and to the product thereby provided.

Electrical insulating coatings are commonly employed for electrical steels which are generally silicon or low carbon steels and are used, for example, in electric motors, generators, and the like. Electrical insulating coatings are, of course, employed on exposed surfaces of parts made of electrical steel in order to eliminate or minimize the conductance of electricity between adjacent steel parts. The insulating coatings desirably have a hard, smooth, glassy finish, good moisture resistance, and good electrical resistance. Desirably, the coatings also strongly adhere to the steel surface and are characterized by minimal dusting and are compatible with other components. Also desirably, the coatings can handle high temperatures, i.e. maintain their mechanical integrity and electrical resistance under high temperature conditions. It would also be advantageous if the electrical resistance coating were applicable to the steel at a low coating weight and a fast low temperature cure time of approximately 30 seconds to facilitate high speed line coating. Of course, the exact specification or characteristics required of an electrical insulating coating are determined by the intended use of the insulated part by the manufacturer or other user of the part.

While it is necessary that the insulating coating meet the requirements of the manufacturer or user, the cost of the coating is also important. Generally speaking, the expense of a coating can be minimized by application of low coating weights and efficient coating process steps. For example, it is desirable to employ a process for applying the coating which facilitates high line speeds such as by employing a short drying step and which avoids high energy usage such as by employing low temperature drying conditions.

In accordance with the present invention, an electrical insulating coating which is capable of meeting manufacturer or user requirements is provided on a ferrous metal surface. The insulative coating of the present invention can generally be employed at economical, low coating weights and can be applied with high speed line coating and with use of conservative amounts of energy.

SUMMARY OF THE INVENTION

In accordance with the present invention, an electrical resistant coating is applied to a ferrous metal surface in a continuous thin film and comprises nitrate in an amount sufficient to provide rapid drying characteristics thereto and phosphate in an amount sufficient to provide electrical resistance thereto. The process of the present invention involves applying the coating to a ferrous substrate by providing a thin film of an acidic aqueous solution thereon and then drying the solution under conservative temperature conditions. The aqueous acidic solution comprises phosphate and nitrate anions and can optionally contain other ingredients such as zinc and nickel cations and colloidal silica.

DETAILED DESCRIPTION OF THE INVENTION

The coated ferrous metal article of the present invention is provided by applying a film of an aqueous solution containing the solids of the desired dried coating to a ferrous metal surface and then drying the film in place. The aqueous solution is a highly acidic aqueous solution comprising phosphate and nitrate anions, and in some instances preferably also nickel cations. If very low coating weights are contemplated, the solution also preferably comprises zinc cations. The ferrous metal article may comprise metal in coil form or otherwise and can be, for example, a stamped part for an electrical motor laminant. Of course, although the metal article will generally be of electrical steel, it will be appreciated that the present invention includes articles of other ferrous metals including other steels and iron.

The coating provided by the acidic aqueous solution comprises nitrate in an amount sufficient to provide low temperature drying characteristics to the coating and phosphate in an amount sufficient to provide the desired electrical resistance to the coating. By low temperature drying is meant that after application to the metal surface, the coating can be dried in place and cured to a peak metal temperature (PMT) of from about 200° F. to about 400° F. for less than about one minute. The coating is cured when it no longer has a tacky feel when touched. By electrical resistance is meant insulation resistance as measured by surface insulation resistance measurement in accordance with ASTM A344-68 tests for surface resistance. The coating of the present invention can obtain an electrical resistance which allows current flow of 0.2 amps/in.$^2$ or less which is suitable for many uses.

The coating of the present invention preferably comprises, on a solids by weight basis, at least 10% nitrate and at least 30% phosphate. Phosphate and nitrate together should comprise at least 50% of the coating. Excessive nitrate in the coating, i.e. more than about 35% can deleteriously affect the electrical resistance of the coating. Phosphate can be as much as 80% of the coating. Preferably, the weight ratio of phosphate to nitrate is at least 1:1. It may also be desired in some instances that the coating contain nickel, preferably in an amount of from about 0.1% to about 7%.

For reasons of economy and efficiency, it is contemplated that the coating of this invention will be applied at coating weights (on a solids basis) of less than 400 mg/ft$^2$ of metal surface since excellent electrical resistance is provided by the present invention even at such low coating weights. Generally, coating weights of from about 200 mg/ft$^2$ to about 400 mg/ft$^2$ will be found to be satisfactory. At coating weights of less than 300 mg/ft$^2$, it is preferred that the coating comprise zinc in an amount sufficient to further improve the electrical resistivity. Preferably, zinc is present in an amount of from about 3 to about 20%, more preferably, about 8% of the coating.

The coating can optionally comprise surfactants or filler materials such as colloidal silica, mica, talc and so forth. For example, the coating can suitably contain from about 0.5% to about 10% colloidal silica.

Generally speaking, the coating is applied to the ferrous metal surface by applying a film of an aqueous acidic solution to the metal surface and then subjecting the solution to drying. Suitable coating solutions contain nitrate and phosphate anions in amounts sufficient to provide a coating in accordance with the foregoing. The coating solution preferably has a pH of less than about 3 especially if zinc is present to avoid precipitation of $ZnHPO_4$ in the treating bath. A low pH also promotes attack of the metal surface and promotes adherance and quality of the coating. In general, a low pH improves the coating obtained.

Phosphate anions can be provided in the coating solution by water soluble phosphate compounds in the solution. For example, zinc acid phosphate solution or phosphoric acid could be employed to provide the phosphate essential to the present invention. Nitrate anions can be provided in the coating solution by water soluble nitrate compounds in the solution such as nickel nitrate or nitric acid. Preferably, the ratio of phosphate to nitrate should be at least 1:1 as set forth above.

If desired, zinc cations can be provided in the solution by water soluble zinc compounds in the solution such as zinc acid phosphate or a solution thereof, and zinc oxide. Similarly, nickel cations can be provided by water soluble nickel compounds. for example, nickel nitrate or a solution thereof. Of course, in addition to these ingredients, the aqueous solution of the present invention can contain the other optional ingredients mentioned hereinbefore such as surfactants and colloidal silica or other filler.

One advantage of the present invention is that the electrical resistant coating can be applied at a relatively high solids content such as is suitable to apply a thin coating of the desired coating weight and electrical resistance using conventional roll coater equipment. For use in such equipment, the coating solution of the present invention suitably comprises from about 10% to about 50% solids. However, a thin film of coating solution can be applied to a steel or iron metal surface by any method which provides a uniform wet film which can then be dried in place to provide the insulative coating on the metal surface.

Although coating weights will vary depending on whether the coating is being applied as a "second coat" over stamped parts that were initially treated in coil form or whether the coating is being applied to untreated parts or coils, in general, a coating weight of 200 to 400 mg/ft$^2$ is desirably applied. Other suitable methods for applying the thin film of coating solution to the metal surface include roll coating, dip and squeegee, dip and air knife, and electrostatic. Of course, the particular choice of method may depend upon the shape of the part being coated. For example, electrostatic coating methods will be suitable for a coil application while squeegee roll coater application might be used for stamped parts.

In accordance with the present invention, after application to the ferrous metal surface the coating can be dried in place and cured by heating to a PMT of 400° F. or less which is substantially below a PMT of 750° F. as is commonly used in the art for conventional aluminum orthophosphate coatings. Further, the cure time of the present coating is less than one minute, generally on the order of 30 seconds. Thus, the coating of the present invention is suitable for use with relatively high line speeds and a conservative amount of energy.

The following Examples, further illustrate the present invention.

EXAMPLE I

A coating solution is prepared containing the following ingredients:

| | Parts by weight |
|---|---|
| ZnO | 37.5 |
| $H_3PO_4$ (75% aqueous solution) | 355.6 |
| $HNO_3$ (42° Be) | 111.1 |
| $Ni(NO_3)_2$ (42.4% aqueous solution) | 34.6 |
| $H_2O$ | 461.2 |

The percent solids content of the solution is about 38%. Using a squeegee coater with grooved hard rubber rolls, a thin film of about 300 mg solids per square foot of panel surface, is applied to a 4 inch by 10 inch siliconized steel panel. Then the film is cured by placing the panel in an oven having an interior temperature of 550° F. until the panel obtains a PMT of about 300° F. which requires about 30 seconds. The panel is then removed and allowed to cool. The coating is not "tacky" when touched and has excellent electrical resistance properties.

EXAMPLE II

A coating solution is prepared containing the following ingredients.

| | Parts by weight |
|---|---|
| ZnO | 37.5 |
| $H_3PO_4$ (75% aqueous solution) | 355.6 |
| $HNO_3$ (42° Be) | 111.1 |
| $Ni(NO_3)$ (42.4% aqueous slution) | 34.6 |
| Victawet 12 | 2.7 |
| Aerosil 200 | 16.4 |
| $H_2O$ | 442.1 |

The percent solids content of the solution is about 40%. Using a squeegee coater with grooved hard rubber rolls, a thin film of about 300 mg solids per square foot of panel surface, is applied to a 4 inch by 10 inch siliconized steel panel. Then thefilm is cured by heating the panel in an oven having an interior temperature of about 550° F. until the panel obtains a PMT of about 300° F. which requires about 30 seconds. The panel is then removed from the oven and allowed to cool. The coating is not "tacky" when touched and has excellent electrical resistant properties.

What is claimed is:

1. The process of providing an insulating coating on a ferrous metal surface comprising:

(a) providing a thin film of an acidic aqueous solution comprising nitrate and phosphate anions on said surface, wherein sadi phosphate and said nitrate respectively comprise at least 30% and 10% of said solution on a dry basis; and (b) curing said film to a peak metal temperature of from about 200°F. to about 400° F.

2. The process of claim 1 wherein said film is applied to said metal surface at a coating weight of less than about 400 mg per square foot of metal surface.

3. The process of claim 2 wherein the solids content of said solution is from about 10% to about 50%.

4. The process of claim 3 wherein said solution has a pH of less than about 3.

5. The process of claim 4 wherein said solution comprises phosphate and nitrate anions in a weight ratio of at least 1:1.

6. The process of claim 5 wherein said solution comprises, in addition, an effective amount of nickel cations for increased electrical resistance.

7. The process of claim 6 wherein said solution comprises, in addition, an effective amount of zinc cations for increased electrical resistance.

8. The process of claim 7 wherein said phosphate and said nitrate together comprise at least 50% of said solution of a dry basis.

9. The process of claim 8 wherein said solution comprises from about 0.1% to about 7% nickel.

10. The process of claim 9 wherein said solution comprises from about 3% to about 20% zinc.

11. The process of claim 10 wherein said film is applied at a coating weight of less than 300 mg/ft$^2$.

12. The process of claim 5 wherein said solution comprises, in addition, an effective amount of zinc cations for increased electrical resistance.

* * * * *